US005769613A

United States Patent [19]

Kim

[11] Patent Number: 5,769,613

[45] Date of Patent: Jun. 23, 1998

[54] COMPRESSOR MUFFLER HAVING SECTIONS INTERCONNECTED BY AN ELASTIC RETAINER

[75] Inventor: Ki-Back Kim, Suwon, Rep. of Korea

[73] Assignee: Samsung Electronics Co., Ltd., Suwon, Rep. of Korea

[21] Appl. No.: 688,026

[22] Filed: Jul. 29, 1996

[30] Foreign Application Priority Data

Jul. 29, 1995 [KR] Rep. of Korea ..... 95-23138

[51] Int. Cl.[6] ..... F04B 21/00

[52] U.S. Cl. ..... 417/312; 417/402; 403/326; 181/229; 181/403

[58] Field of Search ..... 417/312, 902; 181/403, 229; 403/326, 327

[56] References Cited

U.S. PATENT DOCUMENTS 4,477,229 10/1984 Kropiwnicki ..... 417/902

5,207,564 5/1993 Fritchman ..... 417/312

5,542,824 8/1996 Lee ..... 417/312

*Primary Examiner*—Charles G. Freay

*Attorney, Agent, or Firm*—Burns, Doane, Swecker & Mathis, L.L.P.

[57] ABSTRACT

The present invention relates to a muffler apparatus of a compressor for hermetically and easily assembling a suction muffler and a base muffler disposed at the compressor so as to suck and attenuate the noise generated by refrigerant evaporated from an evaporator, the apparatus comprising: a suction muffler for being formed with a suction inlet for the refrigerant to be sucked thereinto and for being formed at one side thereof with a third tripping unit; a base muffler for being formed with a first and a second tripping unit protruded from the base muffler and into the third tripping unit protruded from the suction muffler, so that the base muffler and the suction muffler can be hermetically assembled to leave no gap therebetween.

1 Claim, 5 Drawing Sheets

COMPRESSOR MUFFLER HAVING SECTIONS INTERCONNECTED BY AN ELASTIC RETAINER

BACKGROUND OF THE INVENTION

1. Field of the Invention

The present invention relates to a muffler apparatus of a compressor, and more particularly to a muffler apparatus of a compressor by which noise generated by refrigerant sucked by an evaporator can be absorbed and attenuated, and an absorption muffler and a base muffler disposed at the compressor can be easily assembled.

2. Description of the Prior Art

Generally, a compressor for compressing refrigerant evaporated from an evaporator at a high temperature and under high pressure to thereby supply same to a condenser calls for a muffler constructed in various styles in order to absorb and attenuate the noise generated by the refrigerant absorbed by the evaporator.

As a prior art, U.S. Pat. No. 4,784,581 is disclosed, which is schematically described (FIG. 1 and FIG. 2)

First of all, FIG. 1 is a side elevational view of a conventional reciprocating compressor.

As illustrated in FIG. 1, the conventional reciprocating compressor includes a hermetically-sealed casing 10 except for suction and discharge tubes 2 and 4.

The casing 10 is disposed therein a cylinder block 8 resiliently mounted at a spring 5 in order to reduce transfer of vibration from the compressor to the casing.

Furthermore, an electric motor 9 is arranged at the cylinder block 8.

Meanwhile the casing 10 is disposed at a left side thereof with an ejection cylinder head 91 which in turn is mounted at a valve plate (not shown), so that the refrigerant can pass through an ejection line 94 and an inner passage (not shown) of an ejection muffler 93, and outside of the casing 10.

Furthermore, the ejection cylinder head 91 is fasten by a plurality of bolts 96.

Unexplained reference numeral 71 is an oil tube.

Muffler upper housing 61 is, as illustrated in FIG. 1, extended above the casing 10, and is disposed therein with a projecting deflector 63 adopted to accommodate the gas coming from a tube 2 inwardly extended through an opening 62 and the casing 10.

FIG. 2 is a front elevational view for illustrating a muffler and a cylinder head device of a compressor in FIG. 1.

As shown in FIG. 2, a muffler base 56 includes a skirt 59 in order to accommodate the muffler housing 61.

A tube-type extension unit 55 is hermetically fastened by a connection web 57 and an external rib 58.

A bolt 66 is extended over a metal bracket 64 at an external surface of a cylinder head 81 in order to mount the cylinder head 81 to the cylinder block 8 (see FIG. 1)

The bracket 64 is made of metal such as plate-shaped steel, sides of which are formed with ribs 67, which in turn stop at an ear-shaped outwardly protruding unit 68.

The protruding unit 68 is used to fasten the oil tube 71 having a free end 72.

Reference numeral 42 is v-shaped side surface.

However, there is a problem in the conventional muffler apparatus of a compressor thus constructed in that the muffler base 56 and the cylinder head 81 are connected only by a bolt at the metal bracket 64 which causes a gap to develop between an ejection muffler and a muffler base during operation of the compressor, thus generating noises and deteriorating reliability of the product.

SUMMARY OF THE INVENTION

The present invention is disclosed to solve the aforementioned problems and it is an object of the present invention to provide a muffler apparatus of a compressor by which a suction muffler and a base muffler are easily assembled without developing a gap therebetween, thereby preventing noises generated by refrigerant from being leaked outside, so that reliability of a cooling and heating apparatus can be improved.

In accordance with the object of the present invention, there is provided a muffler apparatus of a compressor, the apparatus comprising:

a suction muffler for being formed with a suction inlet for sucking the refrigerant and for being formed with a third tripping unit at one surface;

a base muffler for being formed with a first and a second tripping units ; and fastening means for being inserted into the first and the second tripping units protruded from the base muffler and into the third tripping unit at the suction muffler.

There is an advantage in the muffler apparatus of a compressor according to the present invention, in that a suction muffler and a base muffler are hermetically and easily assembled to develop no gap therebetween, thus preventing noises generated by the refrigerant from being leaked outside and improving reliability of the product.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

The muffler apparatus of a compressor according to an embodiment of the present invention will now be described in detail with reference to the accompanying drawings.

Figure 1:
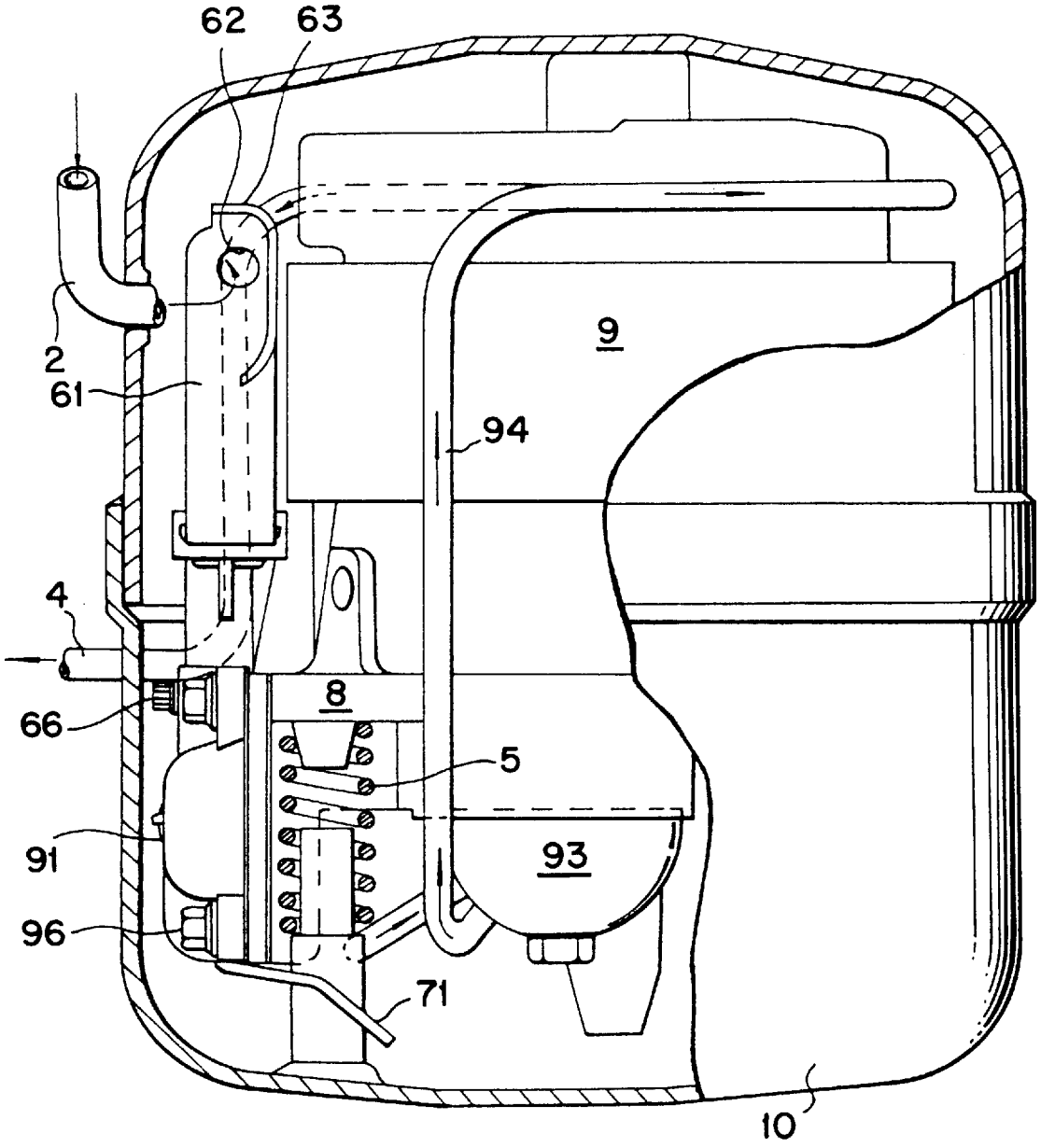
FIG. 1 (PRIOR ART)
FIG. 1, is a side elevational view of a conventional reciprocating compressor.
Figure 2:
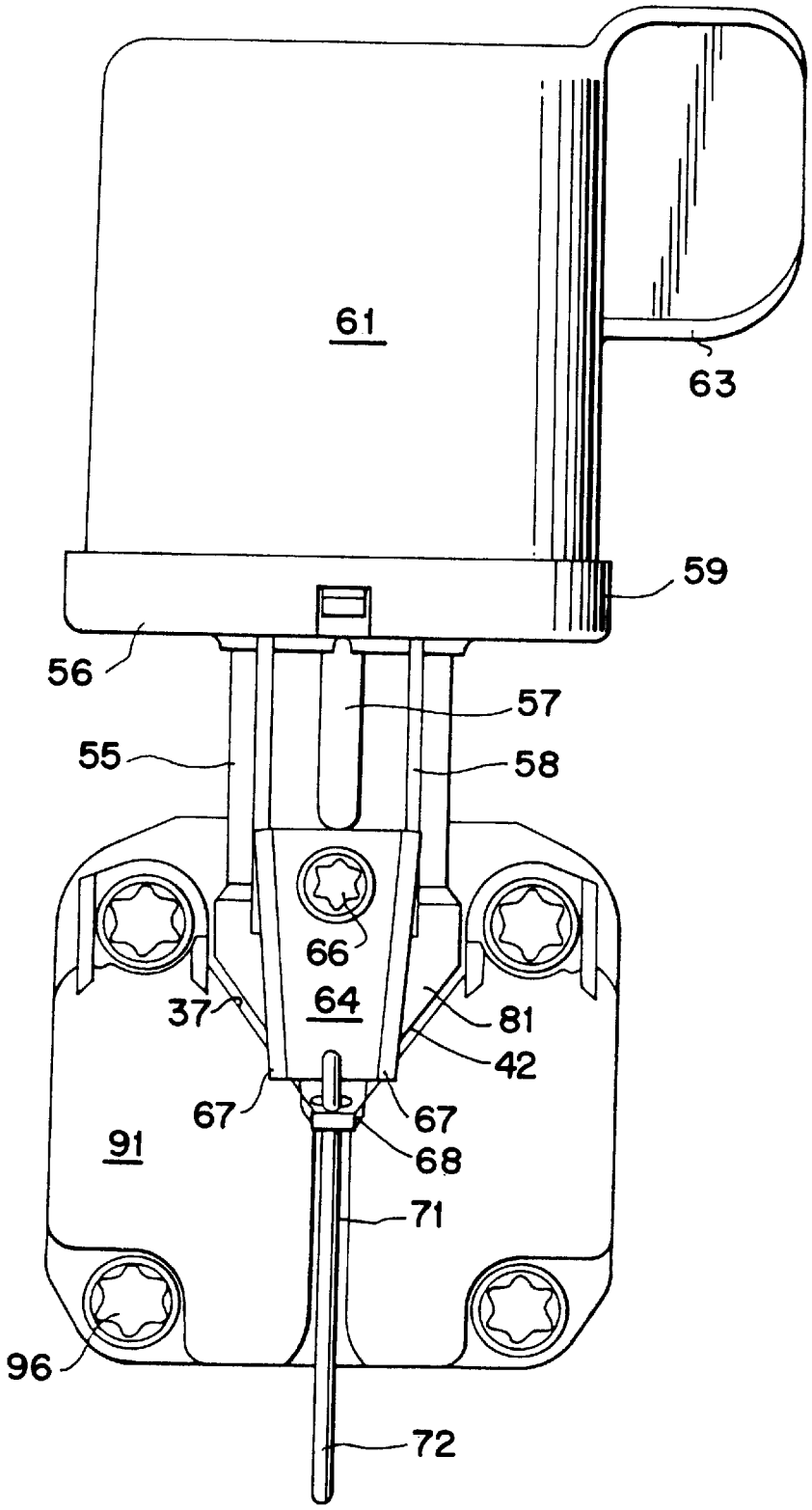
FIG. 2 (PRIOR ART)
FIG. 2 is a front elevational view for a muffler and a cylinder head as principal parts of the conventional reciprocating compressor.
Figure 3:
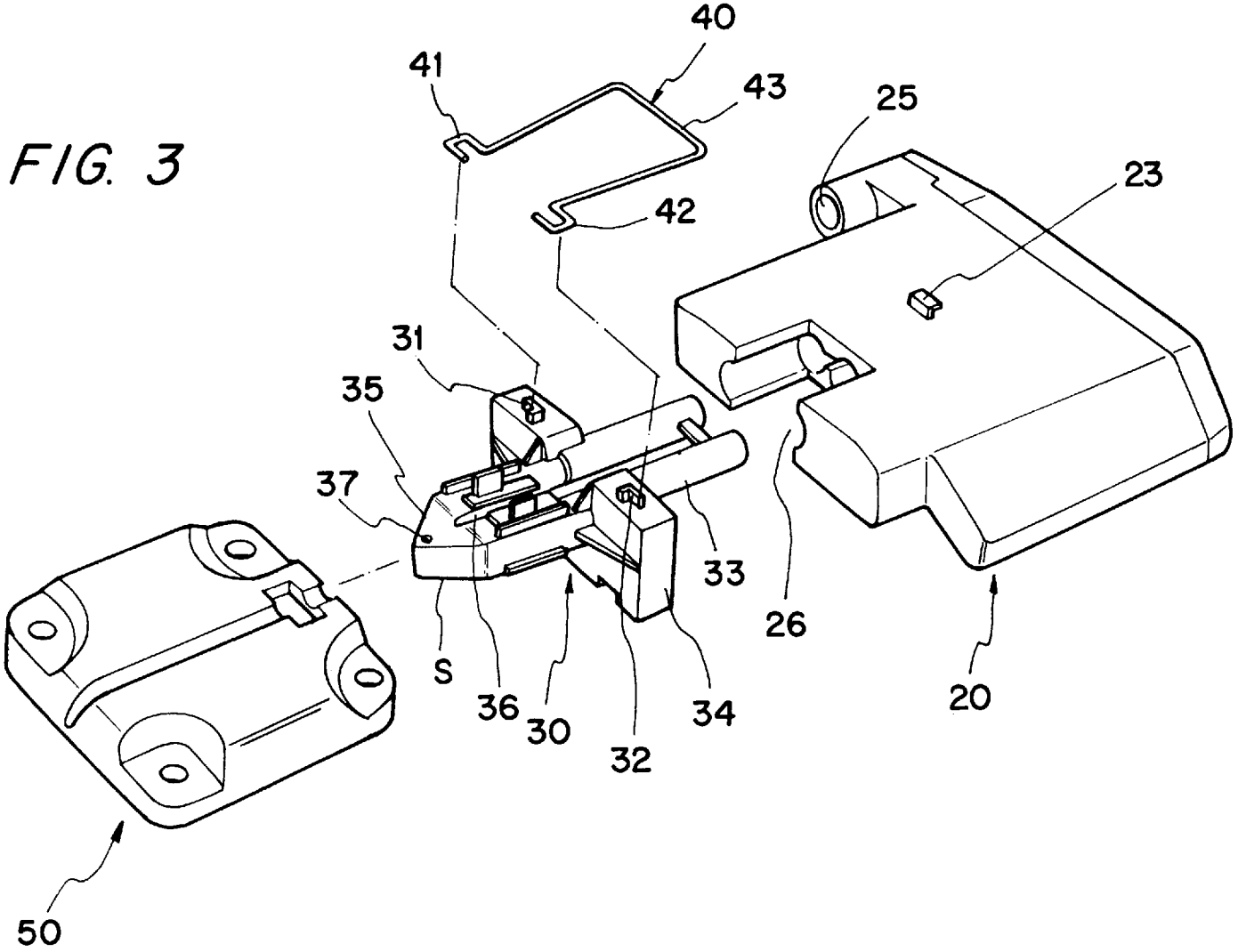
FIG. 3 is an exploded perspective view of a muffler apparatus of a compressor according to the present invention.
Figure 4:
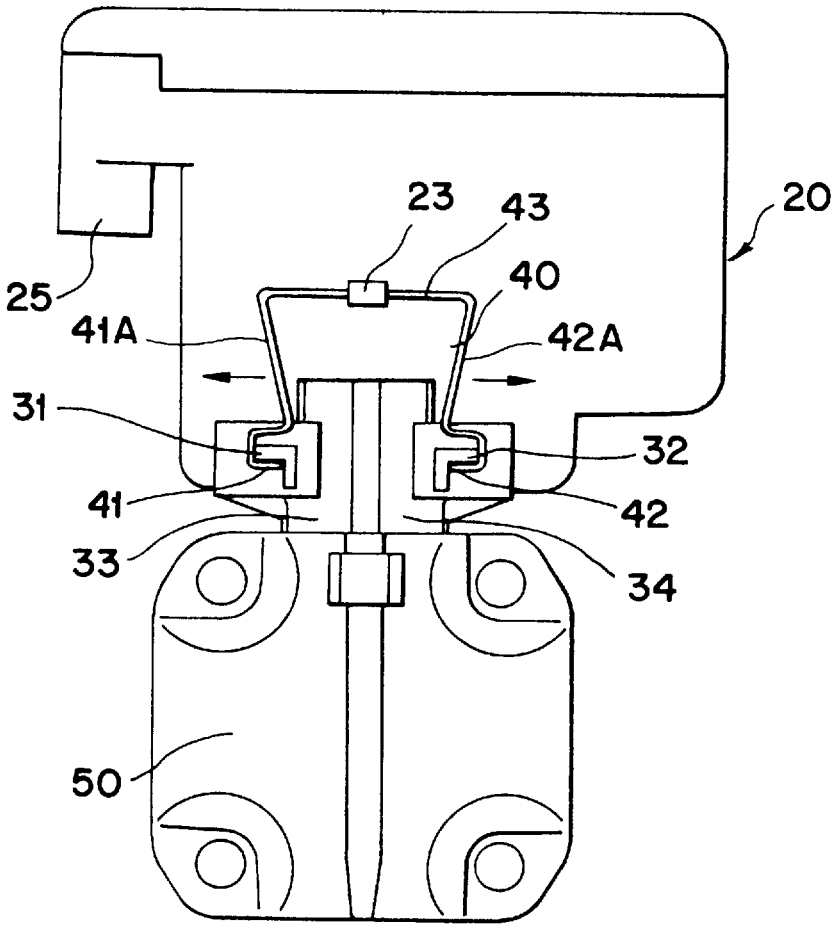
FIG. 4 is a front view for the muffler apparatus illustrated In FIG. 3.
Figure 5:
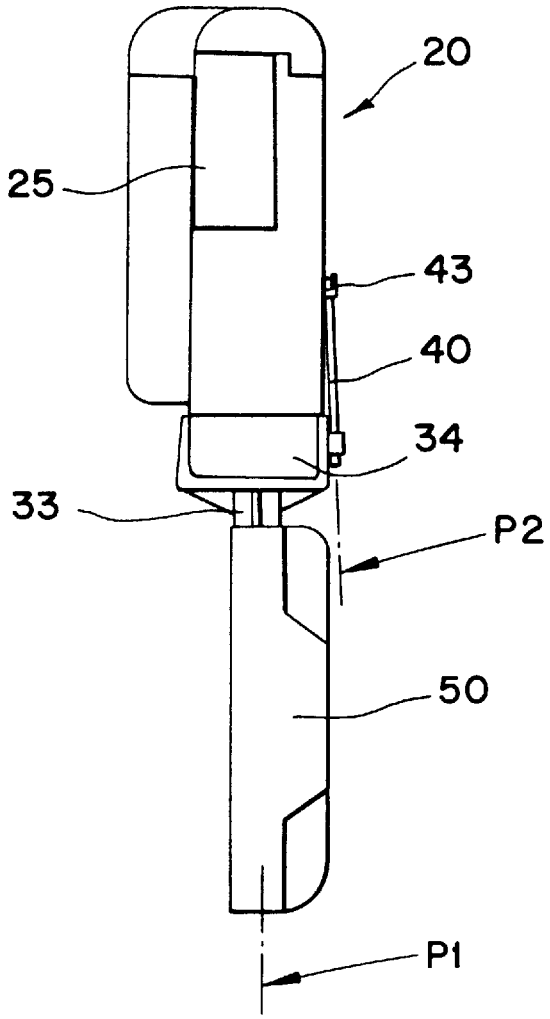
FIG. 5 is a side view for the muffler apparatus illustrated in FIG. 3.

FIG. 3 is an exploded perspective view for illustrating a connected relationship among the suction muffler, base muffler and cylinder head which are principal parts of the muffler apparatus according to the embodiment of the present invention, and FIG. 4 is a front view of the muffler apparatus illustrated in FIG. 3 and FIG. 5 is a side view of the muffler apparatus illustrated in FIG. 3.

Referring to FIG. 3, reference numeral 20 is a suction muffler for sucking and attenuating noise generated by the refrigerant.

The suction muffler 20 is formed at one side thereof with a suction inlet 25 for sucking the refrigerant evaporated from on evaporator (not shown) and is protruding formed at an upper external surface thereof will a third tripping unit or retainer bracket 23 for fastening means 40 to be inserted thereinto Furthermore, the suction muffler 20 is formed thereunder with an insertion unit 26 for a suction tube 33 of a base muffler 30 (described later) to be inserted thereinto.

Meanwhile, reference numeral 30 is a base muffler 30 formed with a suction chamber (S) so that the refrigerant having passed the suction mufflers 20 can be supplied into a cylinder (not shown). The base and suction mufflers 20, 30 lie in a common first plane P1.

The base muffler 30 is disposed at a rear side thereof with the suction tube 33 for being inserted into the insertion unit 26 to thereby guide flow of the refrigerant having passed the suction muffler 20, and is disposed at a front lower surface thereof with the suction chamber (S) for sucking the refrigerant so that the refrigerant having passed the suction tube 33 can be supplied into the cylinder (not shown).

The base muffler 30 is formed at one surface thereof with a base unit 35 arranged with a groove 36 for a capillary member (not shown) to be inserted thereinto.

Between the base unit 35 and the suction tube 33, there is integrally disposed a body 34 respectively formed at the suction base 30, so that the suction muffler 20 can accommodate at one side thereof first and second tripping units or retainer brackets 31 and 32 of the suction base 30.

Furthermore, between the suction muffler 20 and the base muffler 30, there is provided fastening means 40 for fastening the suction muffler 20, and the base muffler 30 lest a gap develop therebetween, as illustrated in FIGS. 3 and 4.

The fastening means 40 is made of material having a predetermined resilient force and is divided into a first, second and a third hook unit 41, 42 and 43.

The first and second hook units 41 and 42 are formed on respective legs 41A, 42A, of the fastening means 40 and are symmetrically bent therebetween, and the third hook unit 43 is bent and extensively formed from the first and the second hook units 41 and 42. The unit 43 defines a connecting portion interconnecting the legs 41A, 42A, which lie in a second plane P2 oriented substantially parallel to the plane P1 (see fig. 5)

In other words, the fastening means 40 is constructed such that the first and second tripping units 31 and 32 of the base muffler 30 are accommodated into the insertion unit 26 to thereafter be protruded out of the body 34, where, the first hook unit 41 is inserted into the first tripping unit 31 and the second hook unit 42 is inserted into the second tripping unit 32 and the third hook unit 43 is inserted into the third tripping unit 23, so that the suction muffler 20 and the base muffler 30 are hermetically connected not to develop any gap therebetween.

Meanwhile, reference numeral 50 is a cylinder head to be connected to a cylinder (not shown).

Next, an assembly procedure of the compressor according to the present invention thus constructed will be schematically described.

First of all, the suction tube 33 of the base muffler 30 is inserted into the insertion unit 26 of the suction muffler 20.

Furthermore, the first and second tripping units 31 and 32 are accommodated into the insertion unit 26 of the suction muffler 20 as illustrated in FIG. 4, so that the suction muffler 20 and the base muffler 30 can be assembled to allow same to be protruded from the body 34 of the base muffler 30.

The third hook unit of the fastening means 40 is caused to be inserted into the third tripping unit 23 of the suction muffler 20, as illustrated in FIGS. 3,4 and 5.

Then, the third hook unit 43 of the fastening means 40 is made to be inserted into the third tripping unit 23 of the suction muffler 20, and the legs 41A, 42A, are flexed apart in an arrow head direction as illustrated in FIG. 4 to thereby allow the first and the second hook units 41 and 42 of the fastening means 40 to be positioned at the first and the second tripping units 31 and 32 of the base muffler 30.

Then, the legs are released for elastic movement in an opposite direction from that of the arrow head by elastic region thereof, so that the first and the second hook units of the fastening means 40 are inserted into the first and second tripping units 31 and 32 of the base muffler 30.

By this, the base muffler 30 and the suction muffler 20 are hermetically assembled to thereby leave no gap therebetween.

After the suction muffler 20 and the base muffler 30 are hermetically assembled by the fastening means 40 to thereby leave no gap therebetween, a tip end of a capillary member (not shown) is inserted into hole 37 of the base muffler 30.

Successively, a base unit 35 of the base muffler 30 is caused to be accommodated into a receptable unit of the cylinder head 50 to allow the cylinder head 50 to be fixed to the cylinder (not shown), which serves to complete the assembly of the muffler apparatus.

Next, an operational effect of the muffler apparatus of a compressor according to the present invention thus constructed will be described.

First of all, when the compressor is activated, the refrigerant evaporated from an evaporator (not shown) is sucked into the suction muffler 20 and the noise generated by the refrigerant in the suction muffler 20 is sucked and attenuated.

The refrigerant is then guided into the suction tube 33 of the base muffler 30 to thereafter by supplied into a suction chamber (S) of the base muffler 30.

The suction muffler 20 and the base muffler 30 are hermetically assembled by the fastening means 40 to have no gap therebetween so that the noise generated by the refrigerant cannot be leaked out, thereby improving reliability of the compressor.

The refrigerant sucked into the suction chamber (S) of the base muffler 30 is sucked into the cylinder by reciprocating motion of a piston to thereafter be compressed in high pressure and high temperature, and is discharged into a discharge chamber of the cylinder head 50 and supplied to the compressor.

As apparent from the foregoing, there is an advantage in the muffler apparatus of a compressor according to the present invention in that a suction muffler and a base muffler are hermetically assembled by fastening means to thereby leave no gap there between, so that the noise generated by the refrigerator is not leaked out to improve reliability of the compressor.

Although the preferred embodiment of this invention has been shown and described, it should be understood that various modifications and rearrangements of parts may be resorted to without departing from the scope of the invention as defined in the claims.

What is claimed is:

1. A muffler apparatus adapted to be connected to a compressor, comprising:

a base muffler section adapted to be connected to a cylinder head of the compressor, the base muffler section including a suction tube for conducting fluid into the base muffler section, and first and second retaining brackets;

a suction muffler section for conducting fluid to the base muffler section; the suction muffler section and base muffler section both lying in a common first plane; the suction muffler section being insertable onto the base muffler section in a direction parallel to the first plane, the suction muffler section including a third retaining bracket; and a generally U-shaped retainer comprising a pair of legs and a connecting portion, the connecting portion including two opposite ends, each of the legs including a first end and a second end, each of the first ends joined to a respective end of the connecting portion enabling the legs to flex elastically toward and away from one another in a second plane oriented substantially parallel to the first plane, the connecting portion being captured by the third retaining bracket at a location between the legs, each of the second ends being generally hook-shaped and configured to capture a respective one of the first and second retaining brackets, the suction and base muffler sections being insertable together to a coupled state when the legs are in an elastically flexed state away from one another, the legs being movable toward one another to a relaxed state upon insertion of the suction muffler section onto the base muffler section to capture the first and second retaining brackets, respectively each of the legs being movable away from the other leg when the suction muffler section and base muffler section are in the coupled state, to enable both seconds ends to be disengaged from the respective first and second retaining brackets.

* * * * *